US005415073A

United States Patent [19]

Ciluffo

[11] Patent Number: 5,415,073

[45] Date of Patent: May 16, 1995

[54] RECOIL REDUCER FOR RIFLE, HANDGUN, OR SHOTGUN

[76] Inventor: Gary Ciluffo, 103 Henderon Hills, Vincennes, Ind. 47591

[21] Appl. No.: 180,455

[22] Filed: Mar. 14, 1994

[51] Int. Cl.[6] ..... F41A 21/36

[52] U.S. Cl. ..... 89/14.3; 89/14.2

[58] Field of Search ..... 89/14.2, 14.3, 14.4; 42/79

[56] References Cited

U.S. PATENT DOCUMENTS

| | | | |
|---|---|---|---|
| 1,390,658 | 9/1921 | Towson | 89/14.3 |
| 2,088,380 | 7/1937 | Methlin | 89/14.3 |
| 2,192,081 | 2/1940 | Hughes | 89/14.3 |
| 2,567,826 | 9/1951 | Prache | 89/14.3 |
| 2,852,983 | 9/1958 | Netzer | 89/14.3 |
| 3,455,203 | 7/1969 | Pillersdorf | 89/14.3 |
| 3,707,899 | 1/1973 | Perrine | 89/14.3 |
| 4,545,285 | 10/1985 | McLain | 89/14.3 |
| 4,570,529 | 2/1986 | A'Costa | 89/14.2 |
| 5,092,223 | 3/1992 | Hudson | 89/14.2 |
| 5,317,825 | 6/1994 | Vatterott et al. | 42/79 |

*Primary Examiner*—David Brown

*Attorney, Agent, or Firm*—Polster, Lieder, Woodruff & Lucchesi

[57] ABSTRACT

A recoil reducer (70) attachable to the muzzle end of a rifle (71), handgun (73, 75), or shotgun to reduce the recoil force produced when the weapon is discharged. An elongate, hollow recoil tube (74, 102) attaches either directly to the muzzle (recoil tube 102) or with an adapter tube (72). The recoil tube has a uniform inner diameter along its length which at least corresponds to the bore of the weapon. The recoil reducer tube has a plurality of slots (90) extending longitudinally of the recoil reducer tube and spaced circumferentially thereabout. Outwardly extending gas deflectors (94) are formed at one end of the recoil reducer tube for discharge gases expelled through the slots to impact curved rear walls (98) of the deflectors. The discharge gasses are directed rearwardly by the deflectors to reduce the weapon's recoil.

5 Claims, 8 Drawing Sheets

RECOIL REDUCER FOR RIFLE, HANDGUN, OR SHOTGUN

BACKGROUND OF THE INVENTION

This invention relates to rifle, handguns, and shotguns and, more particularly, to a recoil reducer or muzzle brake which reduces the recoil force associated with firing the weapon.

The use of choke devices to tighten the shot pattern for a charge fired by a shotgun is well-known. In the past, chokes were separate elements which had to be permanently attached to the muzzle end of a shotgun barrel. To do this, the owner had to send his shotgun to a gunsmith or the the like who either fitted a choke to the existing barrel; or, replaced the barrel with a new one having the choke attached. More recently, shotguns have been provided with a barrel whose muzzle has interior threads. This allows an appropriately made choke to be threaded onto the end of the barrel. The importance of this is that it allows the owner to interchange chokes so he can use one when hunting quail, for example, and a different one for hunting doves.

There are still, however, problems in obtaining as tight a shot pattern as may be desirable for hunting a particular bird or game. For example, a shotgun shell includes both a quantity of shot; i.e., pellets of a given size. It also includes a wadding in which the shot is encased. When the shotgun is fired, the wadding is propelled through the barrel along with the shot. In fact, the shot is carried by the wadding until both are projected from the muzzle end of the shotgun. The wadding may, for example, be thrown 40–50 yards from the shotgun. The wadding spins as it moves through the barrel creating a centrifugal force imparted to the shot. When the shot is ejected from the barrel, it is has both a forward and a sideways force imparted to it. This results in a spread of shot greater than desired. Conventional choke designs do little or nothing to reduce this phenomenon. It is also desirable to reduce the recoil force produced when the shotgun is fired. As with chokes, there are various types of recoil reducers known in the art. Also as with chokes, these devices are attached to the muzzle end of the shotgun with the purpose of redirecting the gases away from the normal direction directly out from the muzzle. In an effort to effect a choke and recoil, some prior devices have been designed to incorporate both functions. However, these devices are relatively ineffective to achieve both desired results, and none resolves the problem created by the wadding as described above.

The positive effects of recoil reduction, less wear on the user, better accuracy, etc., with respect to a shotgun are also true with respect to a rifle or handgun. While there is obviously no place for choke reduction with these weapons, the same device which helps alleviate the problem described above, can, with minor modifications, also be used to provide similar results with rifles and handguns. This is also true with respect to shotguns where there is no choking desired; for example, shotguns used to hunt deer or turkeys and which fire a slug, but where recoil reduction is still desirable.

SUMMARY OF THE INVENTION

Among the several objects of the present invention may be noted the provision of a choke assembly for use on a shotgun to effect a reduction in the dispersion pattern of shot fired from the shotgun; the provision of such a choke assembly which is readily installed on, and removed from, the muzzle end of a shotgun barrel using a simple tool; the provision of such a choke assembly to not be dislodged when steel shot is used in the shotgun; the provision of such a choke assembly to be available in different sizes for use on many different types of shotguns; the provision of such a choke assembly to effectively slow down or stop the spinning of a wadding traveling through the choke thereby to further enhance the choking action produced; the provision of such a choke assembly which also effects a reduction in the recoil of the shotgun; the provision of such a choke assembly to include a recoil reduction attachment which serves to further reduce the recoil force of the shotgun; the provision of such a choke assembly which is self-cleaning; and, the provision of such a choke assembly which is sturdy, portable, readily installed and removed in the field, and easily stored.

With respect to a rifle, handgun, or shotgun that does not have a choke, the present invention provides a significant reduction in the recoil forces experienced when one fires these weapons. There is also the provision of such a recoil reducer whose use makes firing a rifle, handgun, or shotgun less stressful on the user; the provision of such a recoil reducer to improve accuracy by reducing recoil; the provision of such a recoil reducer to be incorporated in the barrel of the weapon and to be interchangeable with the barrel with which the weapon is ordinarily supplied and, the provision of such a recoil reducer which is easy to install or remove from the weapon.

A recoil reducer is attachable to the muzzle end of a rifle, handgun or shotgun barrel to reduce the recoil force created when the weapon is discharged. An elongate hollow tube is attachable to the muzzle end of the barrel of the rifle or handgun. The inner diameter of the tube generally corresponds to that of the barrel at its muzzle end and is constant along the length of the tube. The outer end of the tube has a plurality of slots formed therein. The slots extend longitudinally of the tube and are spaced circumferentially thereabout. Discharge gases propelling a bullet through the barrel tend to flow radially outwardly through the slots. A housing is integrally formed with, or fits over the tube. The housing has opposed deflector surfaces formed at the forward end of the housing for a portion of the discharge gases expelled radially outwardly through the slots to impact against the deflector surfaces and reduce the recoil of the weapon.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF PREFERRED EMBODIMENTS

Figure 1:
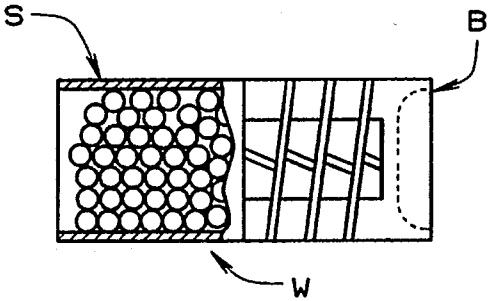
FIG. 1 PRIOR ART
FIG. 1 is a sectional view of the wadding and shot of a shotgun shell.

Referring to the drawings, FIG. 1 illustrates a portion of a conventional shell fired from a shotgun. As shown in FIG. 1, the shell includes a wadding W having a collapsible base B and an upstanding circumferential sidewall S. The shot is carried by the wadding, the shot being pellets of steel or lead. As is well-known, the shot may be of different sizes depending upon the type of game being hunted. Further, though not shown in FIG. 1, sidewall S may have longitudinally extending slits, or other design features to facilitate separation of the shot from the wadding when the shell is fired. Accordingly, in addition to the normal dispersion forces which cause the shot pellets to spatially separate when they leave the muzzle, these sideways forces accentuate, to some degree, the dispersal pattern. When hunting with a shotgun, a major factor in the hunter's success is shot dispersion. Hunters typically know that for a particular shot used to hunt a particular game, what the dispersion is. Usually, the dispersion pattern is a measure of the percentage of pellets which fall within a particular diameter circle at a certain distance (measured in yards).

Hunters have the capability of tightening, or "choking", the dispersal pattern of their shotguns. This is done by installing what is commonly referred to as a choke on the muzzle end of the shotgun barrel. A choke functions by reducing the diameter of the shotgun barrel at its muzzle end. This, in turn, compacts the pellets immediately prior to their discharge. Now, as they spread out, the area which they cover is much smaller in diameter, for a given distance, than for the same weapon without a choke. Initially, the only way a hunter could install a choke was to take or send his shotgun to a gunshop where a choke was permanently affixed to end of the barrel. Later, shotguns were made with internal threads at the muzzle end. The choke then had one end correspondingly threaded so it could screwed on and off by the hunter at his convenience.

Figure 3A:
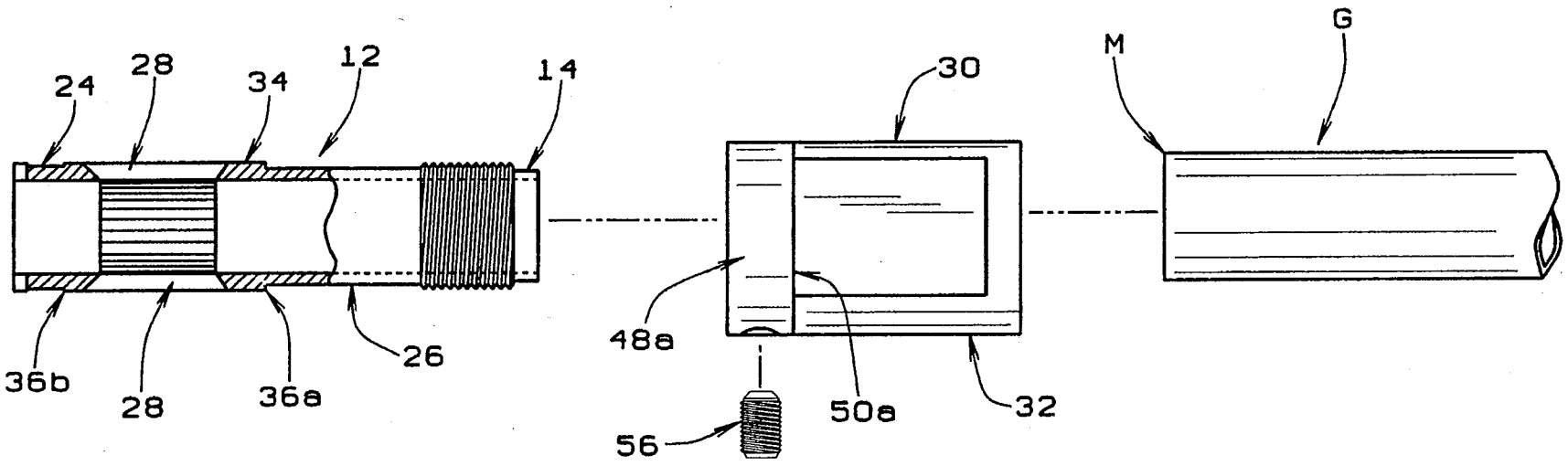
FIG. 3A is an exploded view of the assembly of the present invention.
Figure 3B:
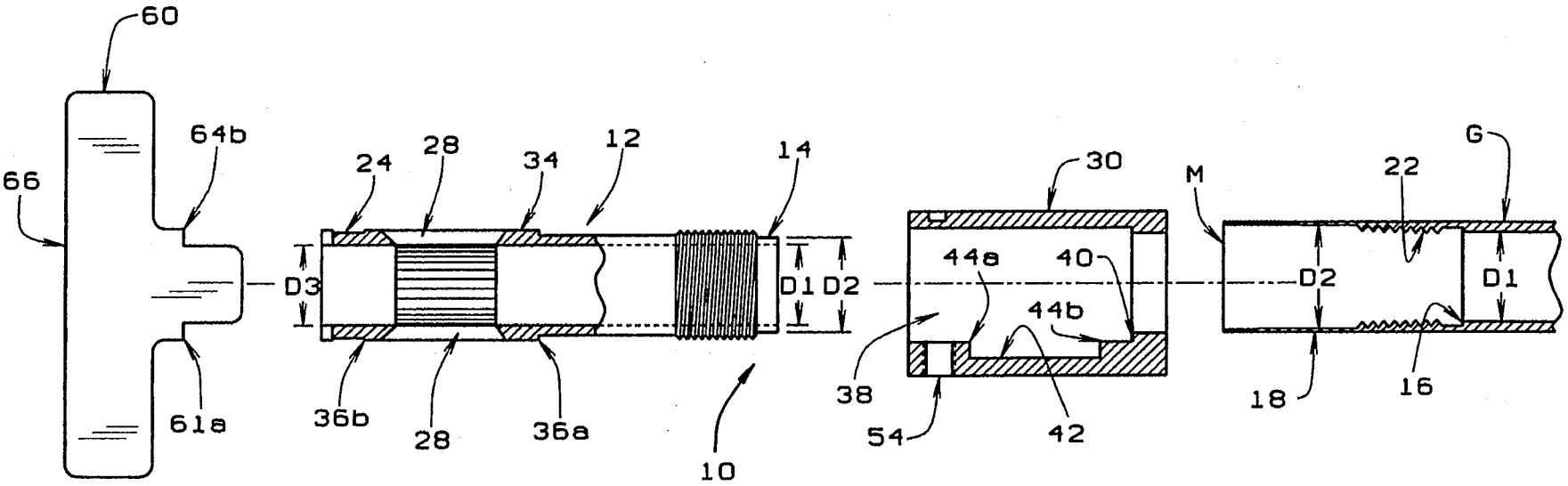
FIG. 3B is a sectional view of the components.

Referring to FIGS. 3A and 3B, a choke assembly 10 of the present invention is attachable to the muzzle end M of a shotgun barrel G to produce a tightened pattern of shot when a shotgun shell is fired from the shotgun. As described above, the shotgun shell includes a plurality of shot and a wadding W carrying the shot it is discharged down the barrel. Choke assembly 10 first includes an elongate hollow tube 12 having a threaded inner end 14 which is threadably received in the muzzle end of the barrel. The inner diameter (i.d.) D1 of tube 12 corresponds to the i.d. of barrel G at its muzzle end. As particularly shown in FIG. 3B, barrel G has a circumferential shoulder 16 formed inwardly of its muzzle end. This shoulder marks a transition in the i.d. of the barrel from a smaller i.d. D1 to a larger i.d. (D2) section 18 at the muzzle end of the barrel. A length of an inner wall 20 of the barrel along section 18 is threaded, as indicated at 22. This length extends forwardly from the shoulder toward the muzzle end of the barrel. Tube 12 has an outer diameter (o.d.) which corresponds to the i.d. D2 of the barrel at section 18. As noted, the i.d. of tube 12, at the inner end of the tube, corresponds to the i.d. D1 of the barrel at shoulder 16. Accordingly, when end 14 of tube 12 is threadably received in the end of the barrel, there is a smooth transition from the shotgun barrel into the inner end of the choke tube.

Figure 5:
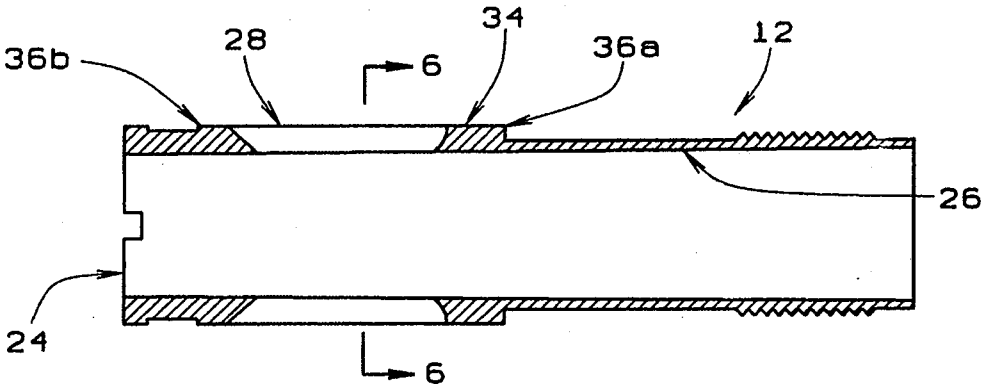
FIG. 5 is a sectional view of the choke portion of the assembly.

Tube 12 has an outer end 24 which extends beyond muzzle M. As shown in FIGS. 3A and 5, the sidewall wall 26 of tube 12 gradually thickens from the inner to the outer end of the tube. Because the o.d. of tube 12 is generally constant along the length of the tube, this gradually increase in wall thickness creates a corresponding decrease in the i.d. of the tube from its inner to its outer end; i.e. a decrease from i.d. D1 to an i.d. D3. This decrease in i.d. produces the choking effect. There can be different amounts of choking depending upon the decreases in i.d. of tube 12. Accordingly, the relative i.d. of tube 12 at its outer end, as shown in the drawings, is illustrative only.

Figure 6:
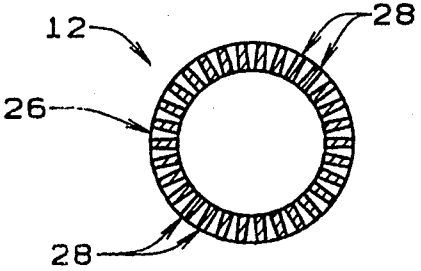
FIG. 6 is a sectional view of the choke taken along line 6—6 in FIG. 5.

It is a particular feature of choke assembly 10 that tube 12 have a plurality of slots 28 formed in the sidewall of the tube at a point intermediate the length of the tube. Slots 28 extend longitudinally of tube 12 and are spaced circumferentially about the choke tube. Referring to FIG. 6, choke tube 12 has, for example, thirty (30) slots 28 formed in sidewall 26 of the choke tube. This corresponds to a slot spacing of 12°. The importance of these longitudinal slots is that they provide escape paths, or vents, for a portion of the discharge gases propelling the wadding and shot through the barrel. Two advantages result. First, the discharging gases are pushing against the wadding, forcing it through the barrel. When the tubing reaches the choke tube, the force of the gases tends to push the tubular wall portion S of the wadding radially outwardly through the slots. This effectively slows the forward impetus of the wadding, but not the shot. Further, forcing the tubing into the slots stops its spinning. This reduces the centrifugal force imparted from the wadding to the pellets which further increases the tightness of the shot pattern. It will be understood that the presence of the longitudinal slots does not capture and hold the wadding in the choke tube because the push provided by the discharge gases is too great. However, the slowing effect produced by the slots is demonstrated by the fact that during field tests of the choke assembly, wadding was found as near as twenty (20) feet from the shotgun as opposed to the forty or so yards, as mentioned previously, wadding is typically thrown.

Figure 2A:
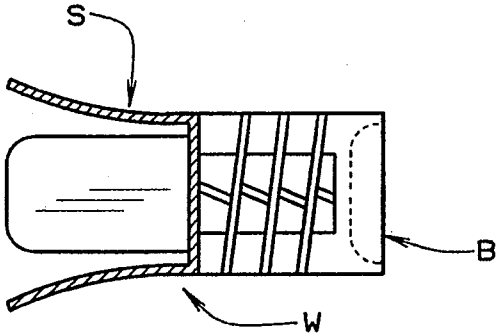
FIG. 2A PRIOR ART
FIG. 2A is a sectional view of the wadding after the shell has been fired.
Figure 2B:
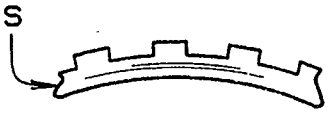
FIG. 2B PRIOR ART
FIG. 2B is a partial end view of a sidewall of the wadding.

As noted above, gas pressure pushes the sidewall of the wadding outwardly through the longitudinal slots formed in the choke tube. Further, as shown in FIG. 5, it will be noted that each end of each slot angles outwardly from the inner surface of tube sidewall 26. This angling is important because as the wadding sidewall is pushed outwardly through the slots, the forward end the sidewall S contacts the respective slopes formed by the angled ends of the slots. The forward, angled end of the slots correspondingly act as "planes" to shave off some of the plastic material forming the wadding. This effect is shown in FIG. 2B. Here, the grooves represent the shaved portions of the sidewall. The result of the slot design is to accentuate the stopping action provided by the slots to both slow down the wadding and stop its spinning through the barrel.

It will be understood that the slope angle at the ends of the slot may vary. The actual angle is determined by the overall design features required of the choke.

The effect of choke assembly 10 is to greatly increase the tightness of shot dispersion. As an example, an article in *Guns & Hunting,* May, 1993, titled *Patterns of Success,* by Nick Sisley, Shotgun Editor, describes measuring shot dispersion patterns. As described therein, a 48"×48" target has a 30" diameter circle drawn on it. The target is fired at from 40 yards, and the number of pellets hitting inside the circle are counted. The article indicates that a good, full pattern would mean approximately 78% of the pellets landing within the circle. Further, the articles indicates that with some shotgun, choke, and load combinations, 80%-85% hits within the circle might be attainable. In field tests using the choke assembly of the present invention, pellet counts of over 90% were consistently achieved.

The second important advantage of slots 28 is that by allowing a portion of the discharge gases to be expelled radially outwardly through the slots, the shotgun's recoil is reduced. It is well understood that venting discharge gases effectively reduces the recoil forces of the shotgun. However, the present invention increases the effectiveness of this vention to further reduce recoil. In this regard, choke assembly 10 further includes a recoil reducer 30 in which choke tube 12 is installed prior to threading end 14 of the choke tube into the muzzle end of the shotgun barrel. Reducer 30 includes a hollow tube 32 sized to accommodate the choke tube. The choke tube has an increased diameter central section 34 having a circumferential shoulder **36*a*, 36*b* at each respective end. Tube 32 has central longitudinal bore 38. The forward end of the bore has an i.d. corresponding to the o.d. of choke tube section 34. A circumferential shoulder 40 is formed at the rearward end of this bore and shoulder 36*a* of choke tube section 34 abuts against this shoulder when the choke tube is inserted in the bore. The shoulder serves to decrease the i.d. of bore 38 to a diameter corresponding to the o.d. of inner end 14** of the choke tube.

Next, the recoil reducer has an annular groove 42 extending partway around the circumference of tube 32. (See FIG. 4B.) Groove 42 has a length corresponding to that-of the slots 28 and the groove is formed so its forward and rear walls **44*a*, 44*b* respectively register with the forward and rearward ends of the slots (see FIG. 4A). This means all the discharge gases escaping through the slots adjacent groove 42** escape into the groove. The gases then flow through the groove and into the atmosphere at the respective ends of the groove.

At the forward end of the recoil reducer, opposed gas deflectors **48*a*, 48*b* are formed. Each deflector comprises an outward extension formed on a respective side of the frontal portion of the reducer. The front face of each deflector corresponds with the front face of tube 32 so to be uniform across the front of the recoil reducer. The rearface 50*a*, 50*b* respectively has a groove or channel 52*a*, 52*b* respectively formed in it. The rear face is positioned adjacent the forward end of the slots 28** in the choke tube so gases escaping the choke tube blow into the channels. The outer end of each channel is curved rearwardly so gases blown into the channels are deflected rearwardly. This rearward deflection produces a counter-force pushing forward. This counter-force serves to further reduce the recoil force created when the shotgun is fired.

Figure 4A:
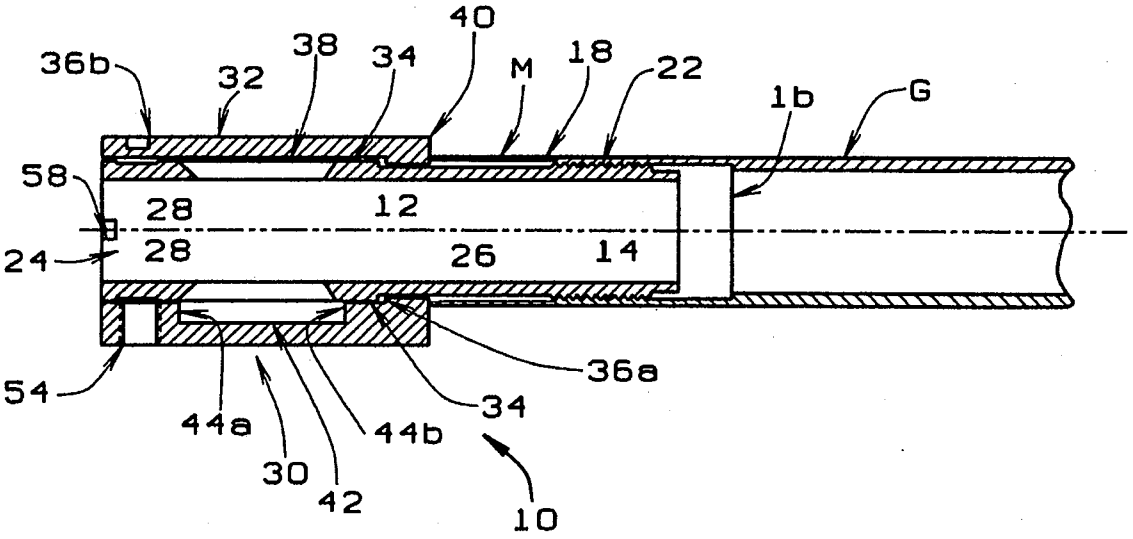
FIGS. 4A and 4B are respective sectional and end views of the apparatus installed on a shotgun.

A screw hole 54 is formed in the bottom of the front portion of the recoil reducer. An allen screw 56, for example, fits in the screw hole, after the choke tube is installed in the recoil reducer to attach the two pieces firmly together. Typically, the screw is not tightened until the choke tube is threaded into the end of the barrel. Then, the recoil reducer is rotated until the deflectors **48*a*, 48*b* extend to the sides of the assembly. For installing the choke tube, the front end of the choke tube has opposed slots. A wrench 60 has a center tab portion 62 the width of which corresponds to diameter D3 of the choke tube for the tab to fit into the outer end of the tube. To either side of the tab are shoulders 64*a*, 64*b* which respectively fit into slots 58 (one of which is shown in FIG. 4A. A handle portion 66** of the whench is wide enough to allow the user to comfortably turn the wrench, even in the field, to thread the tube into, or out of, the muzzle.

What has been described is a choke for use on a shotgun to reduce the dispersion pattern of shot fired from the shotgun. The choke which is readily installed and removed from the muzzle end of a shotgun barrel using a simple tool. Also, the choke is designed to not be dislodged from the shotgun when shells having steel shot are fired from the gun. To accommodate the various sizes of shotguns, the choke is available in different sizes. A significant advantage of the choke design is that it effectively slows down or stops the spinning of wadding propelled through the barrel with the shot when the gun is fired. The apparatus also includes a recoil reduction attachment which acts to reduce the recoil force of the shotgun. The choke which is sturdy, portable, readily installed and removed in the field, easily stored at home, and is self-cleaning in that the discharge gases moving through the barrel force out any particles remaining in the barrel from a previously fired shell.

It will be understood that the above described assembly can be used solely for the purpose of providing a recoil reducer or muzzle brake for the shotgun. As such, it is applicable to shotguns shooting slugs for deer hunting or turkey hunting for example. The difference in the construction of assembly 10 for this purpose is that the inner diameter of the bore of tube 12 is uniform along the length of the tube and corresponds to that Of the shotgun barrel. This eliminates any choking action of the assembly. However, gases discharged through the slots 28 impact against the rear face **50*a*, 50*b* of recoil reducer 30** and are deflected reflected rearwardly to lessen the recoil of the shotgun.

It will be further understood that as a recoil reducer, assembly 10 is also usable with a rifle or handgun as well as with a shotgun. A rifle or handgun barrel could be counter-bored from its muzzle end with the counter-bored being tapped so the threaded inner end of tube 12 screw fits onto the end of the barrel. Again, the inner diameter of tube 12 is uniform along the length of the tube and corresponds to the diameter of the barrel for the caliber of bullet fired from the weapon.

Figure 10:
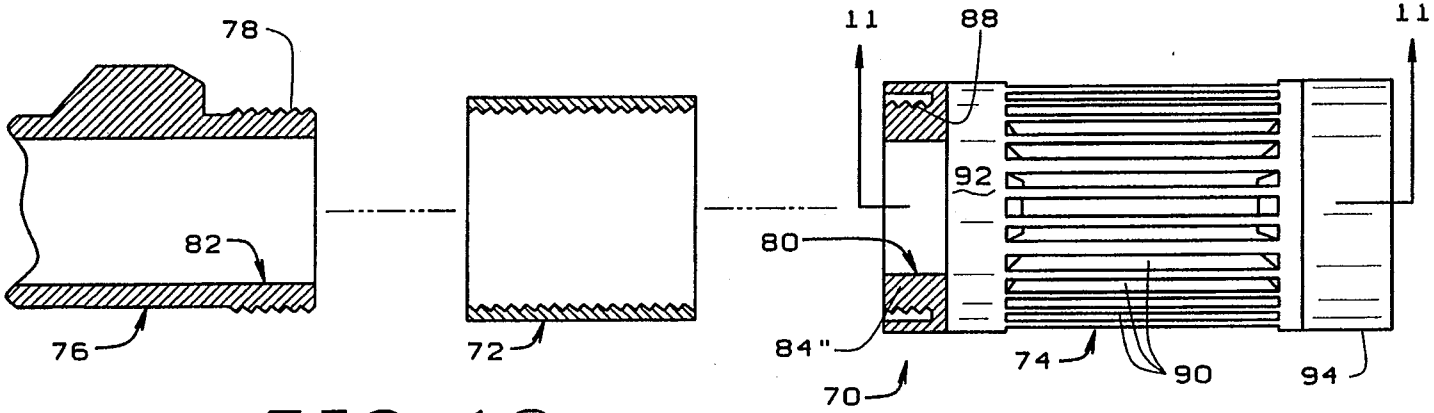
FIG. 10 is an exploded view, partly in section, of a recoil reducer for use with rifles, handguns, and shotguns.
Figure 13:
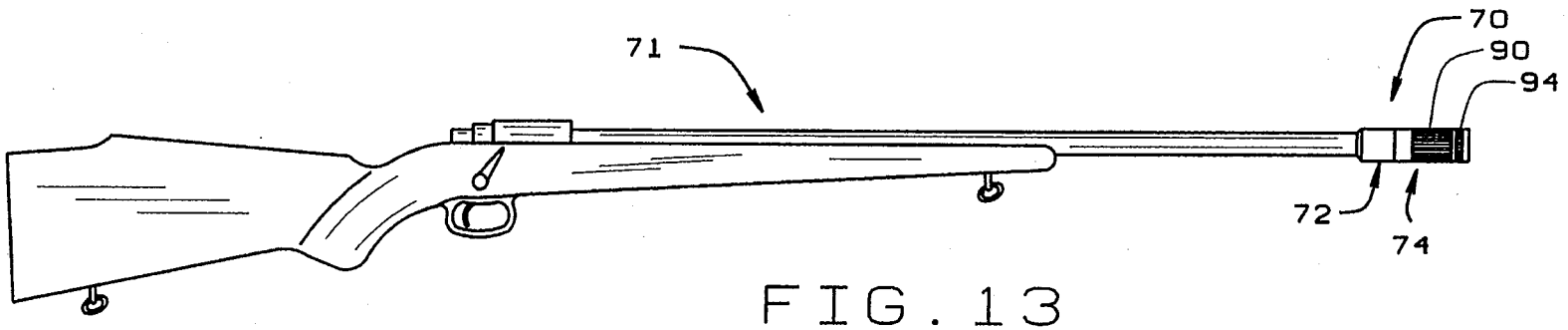
FIG. 13 is an illustration of the recoil reducer installed on a rifle.
Figure 14:
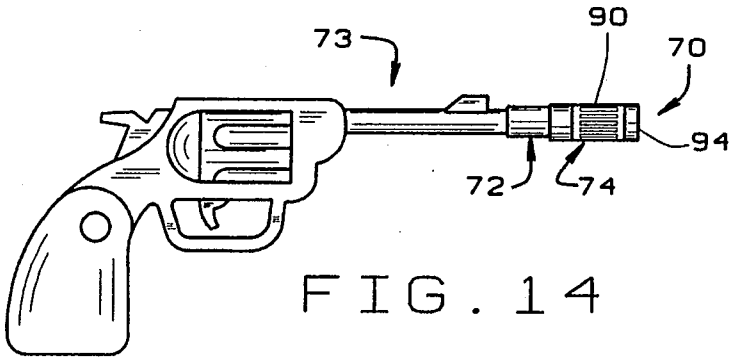
FIG. 14 is an illustration of the recoil reducer installed on a revolver.
Figure 15:
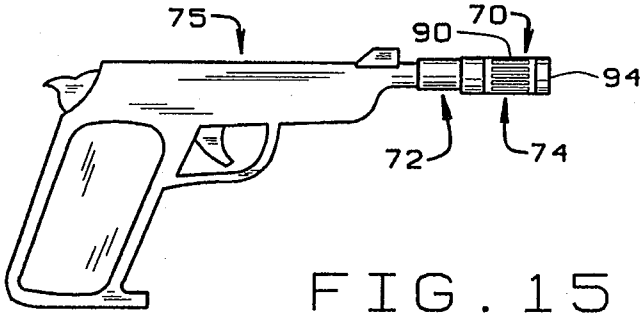
FIG. 15 is an illustration of the recoil reducer installed on an automatic handgun.
Figure 11:
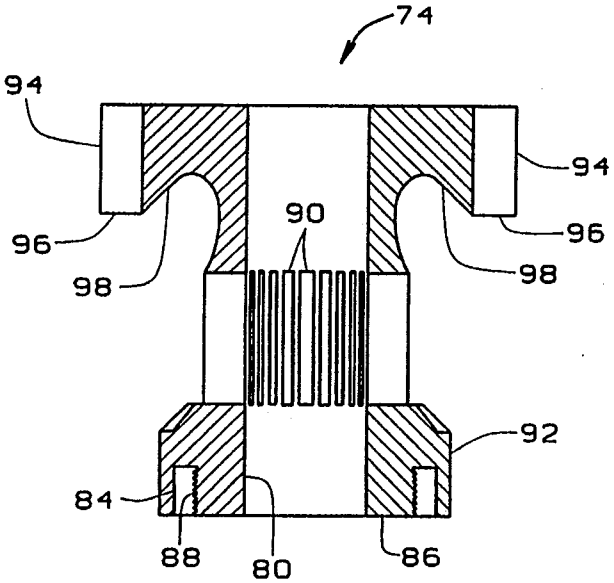
FIG. 11 is a sectional view of a recoil reducer housing taken along line 11—11 in FIG. 10.
Figure 16B:
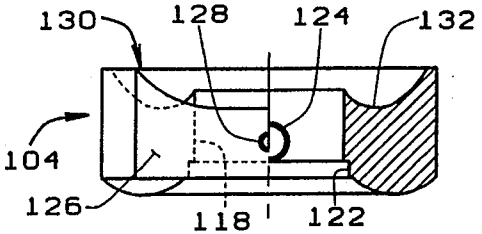
FIGS. 16A–16C are a front elevational view, top plan view partly in section, and a side elevational view, in section, of a deflector housing of the embodiment of FIG. 12; and, FIGS. 17A–17C illustrate the recoil reducer of the present invention incorporated with the barrel of the rifle, handgun, or shotgun.
Figure 16C:
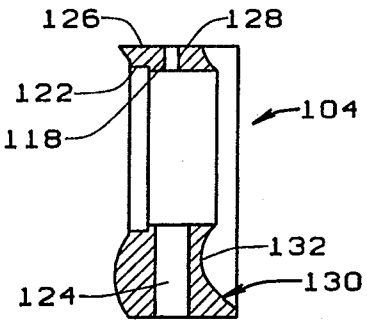
Figure 16A:
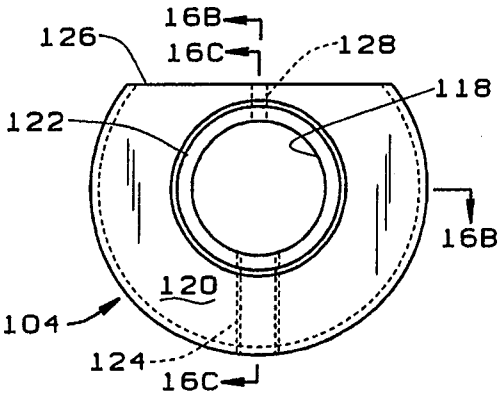

For use as a recoil reducer, on rifles, handguns, and shotguns, alternate embodiments of the invention can also be used. A recoil reducer 70 is shown in FIG. 13 as installed on a rifle; in FIG. 14, on a revolver; and in FIG. 15, on a automatic handgun. It will be understood that the recoil reducer is also installable on a shotgun. As shown in FIG. 10, a recoil reducer 70 has two interfitting components, an elongate internally threaded adapter tube 72, and a recoil reducer tube 74. The outer end of the barrel 76 of a weapon is externally threaded as indicated at 78. The inner diameter of tube 72 corresponds with the outer diameter of the barrel, and the internal threads of the tube matingly fit with the external threads on the barrel so the tube can be screwed onto the end of the barrel. Recoil reducer tube 74 has a smooth longitudinal bore 80 (see FIG. 11), the diameter of which corresponds to the bore 82 of barrel 76. An annular groove 84 extends inwardly into the rear face 86 of the recoil reducer. The inner wall 88 of the groove is threaded. The width of the groove corresponds to the wall thickness of tube 72 and the diameter of groove, from the longitudinal center line of bore 80 to wall 88 is the same as the i.d. of tube 72. This allows the recoil reducer to be threaded onto the outer end of the tube.

Recoil reducer tube 74 has elongate slots 90 which extend circumferentially of the side wall 92 of the recoil reducer in the same manner as the slots 28 previously described. The forward end of the recoil reducer is similar in construction to the recoil reducer 30. That its, opposed gas deflectors 94 are formed at the forward end of the reducer and comprise outward extensions on respective sides of the frontal portion of the reducer. Again, the front face of each deflector corresponds with that of the reducer so to be uniform across the front face of the reducer. The rear face 96 of each deflector has a groove or channel 98. The rear faces are positioned adjacent the forward end of the slots 90 and the outer end of the rear face curve rearwardly so gases discharging through the slots 90 are deflected rearwardly to produce a force pushing forwardly and opposing to the rearward recoil force.

Figure 12:
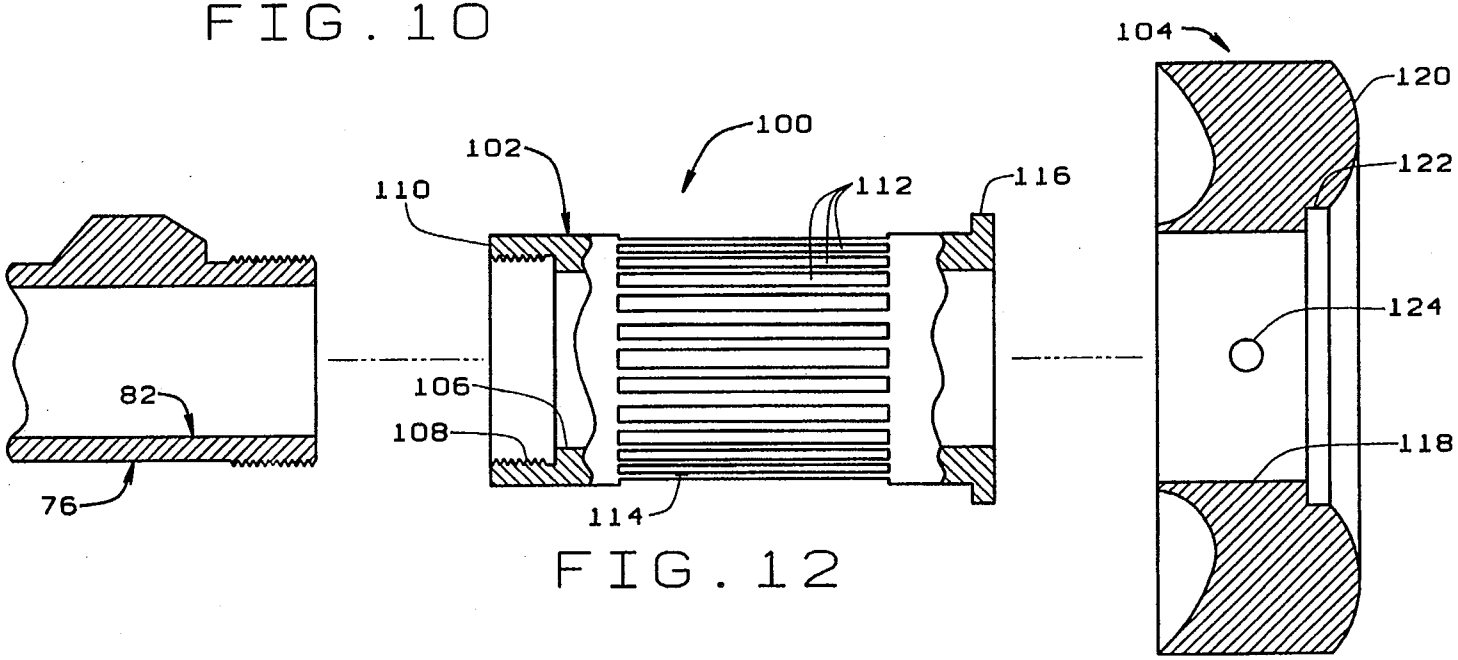
FIG. 12 is an exploded view, partly in section, of another embodiment of the recoil reducer.

Referring to FIG. 12, another embodiment of the invention is indicated generally 100 and includes an elongate tube 102 having a central bore 106 whose diameter corresponds to bore 82 of barrel 76. As before, the end of barrel 76 is externally threaded. A counter-bore 108 is formed in the rear face 110 of tube 102 and the sidewall of the counter-bore is threaded. The diameter of the counter-bore corresponds to the outer diameter of barrel 76 for the tube to be threaded onto the end of the barrel. Elongate longitudinal slots 112 are formed in the sidewall 114 of tube 102 intermediate the length of the tube. Slots 112 correspond to slots 28 and extend about the circumference of the tube. A circumferential flange 116 extends radially outward from the tube at the forward end of the tube.

Recoil reducer 104 has a central bore 118 whose diameter corresponds to the o.d. of tube 102. The front face 120 of the recoil reducer has a forwardly projecting rounded bulge which extends about the circumference of the reducer. Adjacent the front end of bore 118 is a circumferential shoulder or groove 122 whose diameter corresponds to the diameter of the flange 116 of tube 102, and whose depth corresponds to the thickness of the flange. The groove allows the recoil reducer to be fitted onto tube 102 with the-flange end of the tube seating in groove 122. As shown in FIG. 12, a threaded hole 124 extends through the recoil reducer. The hole is tapped for a screw (not shown) to be threaded through the hole and contact tube 102 to lock the recoil reducer in place.

Figure 4B:
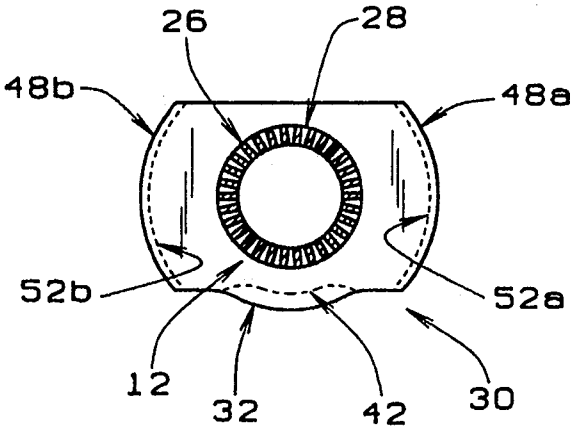
Figure 7:
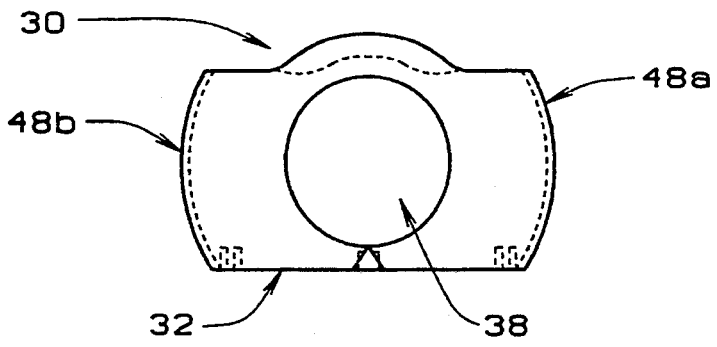
FIG. 7 is a front view of muzzle brake or recoil reducing portion of the assembly.
Figure 8:
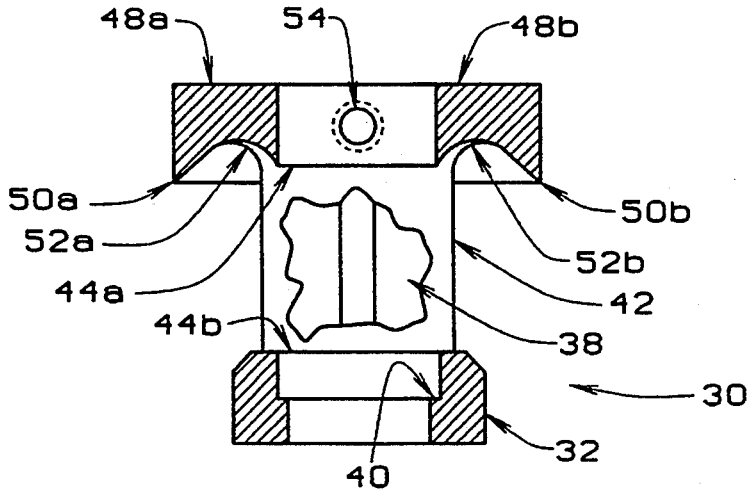
FIG. 8 is a bottom plan view, partially broken away, of the muzzle brake.
Figure 9A:
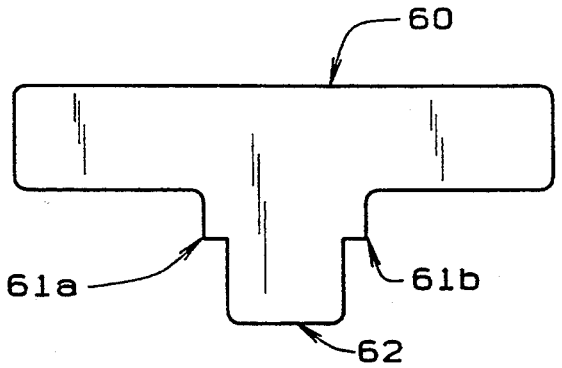
FIGS. 9A and 9B are respective plan and elevational views of a tool for installing the apparatus.
Figure 9B:
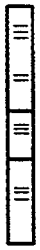

Unlike recoil reducer 30 which has a deflector with a bulge formed on its underside (as shown in FIG. 4B), recoil reducer 104 has a uniform outer diameter. The top portion of the reducer is truncated to provide a smooth, flat top surface 126. A screw hole 128 may be formed in surface 126 for a locking screw (not shown). The rear face 130 of the reducer has a channel 132 formed therein. As with unit 70, the channel is designed so discharges gases coming out of slots 112 are deflected rearward and produce a forward force which counteracts the recoil force of a weapon.

Figure 17B:
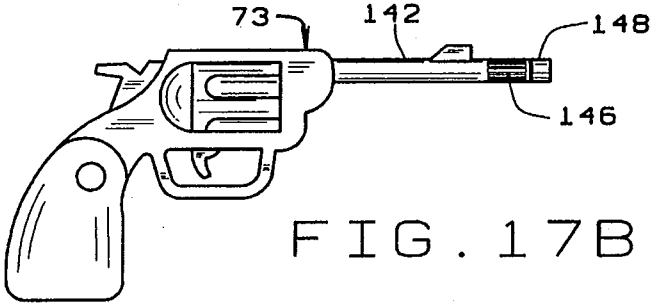
Figure 17A:
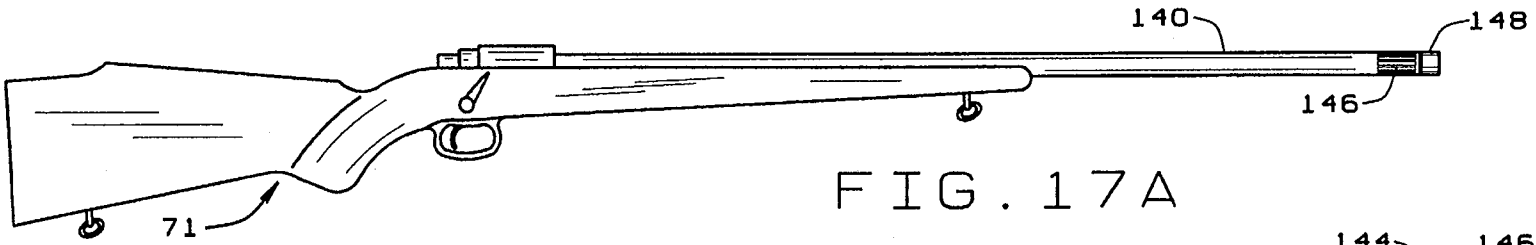
Figure 17B:
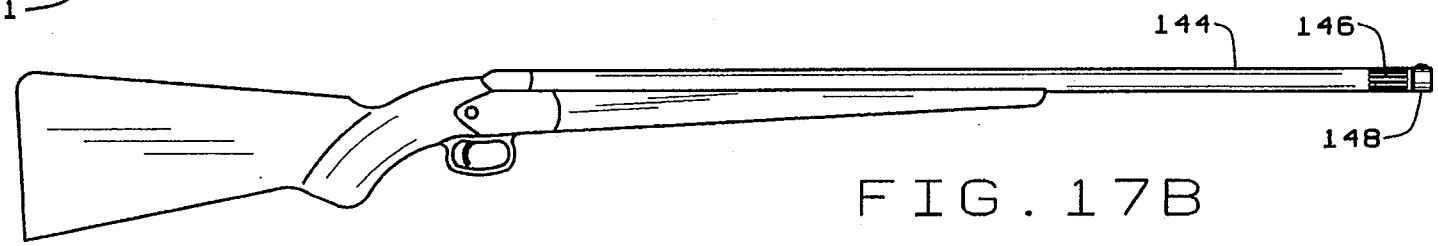

Finally, as shown in FIGS. 17A–17C, a rifle, handgun, or shotgun can have a barrel 140, 142, or 144 respectively which is interchangeable with the standard barrel on the weapon. Each substitute barrel has longitudinal extending circumferential slots 146 adjacent the end of the barrel and deflector surfaces 148 extending around the sides and bottom of the barrel. The substitute barrels would replace the original barrels on the weapon as the user deemed appropriate and would function as previously described.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A recoil reducer for a weapon such as a handgun, rifle, or shotgun to reduce the recoil force produced when the weapon is discharged comprising:

an elongate, hollow recoil tube an inner end of which is attached to a muzzle end of a barrel of the weapon, said tube having a uniform inner diameter throughout its length which, at least, corresponds to the bore of the weapon;

a plurality of spaced slots formed in said recoil tube, said slots extending longitudinally of said tube substantially the length thereof, each end of each slot angling outwardly from an inside wall of said tube to an outside wall thereof for the length of said slots, on the outside of the tube, to be longer than the length of the slots on the inside of the tube, said angled end of said slots helping direct discharge gases created when the weapon is discharged outwardly through the side of the recoil tube; and gas deflector means for deflecting discharge gases emitted from the barrel when the weapon is discharged, said discharge gases being deflected rearwardly of the weapon to lessen the recoil force produced at discharge, said gas deflector means including a gas deflector positioned at an outer end of said recoil tube and extending radially outwardly from said recoil tube circumferentially thereabout, said gas deflector having a from face and a rear face, said rear face having an annular channel formed therein and extending arcuately the length of said gas deflector to direct discharge gases striking the rear face of said gas deflector rearwardly of said weapon to reduce the recoil force.

2. The recoil reducer of claim 1 further including an elongate, hollow adapter tube one end of which attaches to the muzzle of said barrel and the other end of which attaches to said recoil tube, the inner diameter of said adapter tube corresponding to the outer diameter of the barrel, and the inner end of said recoil tube attaching to the other end of said adapter tube.

3. The recoil reducer of claim 1 wherein said gas deflector has a central opening therein through which a projectile discharged by said weapon exits said recoil reducer, and a circumferential seat formed about said central opening, an outer end of said recoil tube having a circumferential flange formed thereon and sized to fit in said seat to attach said gas deflector to said recoil tube.

4. The recoil reducer of claim 3 wherein an outer end of each of the slots is adjacent said channel in said gas deflector for said discharge gases to flow directly into said channel.

5. The recoil reducer of claim 4 wherein the slots are formed in the barrel, and said gas deflector means are formed at the muzzle end of the barrel.

* * * * *

UNITED STATES PATENT AND TRADEMARK OFFICE

CERTIFICATE OF CORRECTION

PATENT NO. : 5,415,073
DATED : May 16, 1995
INVENTOR(S) : Gary Ciluffo

It is certified that error appears in the above-indentified patent and that said Letters Patent is hereby corrected as shown below:

Column 8, line 68, Claim 1, "from" should be -- front --.

Signed and Sealed this

Twenty-sixth Day of March, 1996

Bruce Lehman

*Attest:*

BRUCE LEHMAN

*Attesting Officer*

*Commissioner of Patents and Trademarks*

--